US005921746A

United States Patent [19]

Yu et al.

[11] Patent Number: 5,921,746

[45] Date of Patent: Jul. 13, 1999

[54] FUEL PUMP CHAMBER WITH CONTAMINATION CONTROL

[75] Inventors: Dequan Yu, Ann Arbor; Robert Duane Gaston, Dearborn Heights, both of Mich.

[73] Assignee: Ford Motor Company, Dearborn, Mich.

[21] Appl. No.: 09/172,425

[22] Filed: Oct. 14, 1998

[51] Int. Cl.[6] ..... F04D 1/04

[52] U.S. Cl. ..... 415/55.1; 415/55.2; 415/55.3; 415/55.4; 415/121.2

[58] Field of Search ..... 415/55.1, 55.2, 415/55.3, 55.4, 169.1, 169.2, 121.2

[56] References Cited

U.S. PATENT DOCUMENTS 3,851,998 12/1974 Downing .
3,879,294 4/1975 Ellis et al. .
4,312,751 1/1982 Casamitjana .
4,406,594 9/1983 Smaby et al. .
4,408,953 10/1983 Nasvytis et al. .
4,502,954 3/1985 Druffel .
5,078,875 1/1992 Losing .
5,310,308 5/1994 Yu et al. .
5,409,357 4/1995 Yu et al. .
5,415,521 5/1995 Hufnagel et al. .
5,601,398 2/1997 Treiber et al. .

*Primary Examiner*—F. Daniel Lopez
*Assistant Examiner*—Matthew T. Shanley
*Attorney, Agent, or Firm*—Jerome R. Drouillard

[57] ABSTRACT

An electric-operated fuel pump (20) has a vaned impeller (28, 28') that is disposed within a pumping chamber (27) for rotation about an axis (21). The pumping chamber has a main channel (42) extending arcuately about the axis to one axial side of the impeller. The main channel has a radially outer margin that opens (58) along at least a portion of the channel's arcuate extent to an adjoining contaminant collection channel (56) which extends arcuately about the axis and which is effective, as the pumping element rotates, to collect certain fluid-entrained particulates expelled from the main channel and to convey such collected particulates toward the pump outlet (40). A sump (72) is disposed at the end of the contaminant collection channel proximate the outlet. The impeller (28') has a ring (70) girdling the impeller vanes (52) with a radially inner surface that is slightly concave in axial cross section.

11 Claims, 4 Drawing Sheets

FUEL PUMP CHAMBER WITH CONTAMINATION CONTROL

FIELD OF THE INVENTION

This invention relates generally to pumps, and in particular to vaned impeller pump useful as an electric-motor-operated fuel pump for an automotive vehicle to pump liquid fuel from a fuel tank through a fuel handling system to an engine that powers the vehicle.

BACKGROUND INFORMATION

In an automotive vehicle that is powered by an internal combustion engine, fuel may be pumped through a fuel handling system of the engine by an in-tank, electric-motor-operated fuel pump.

Examples of fuel pumps are shown in various patents, including U.S. Pat. Nos. 3,851,998; 5,310,308; 5,409,357; 5,415,521; 5,551,875; and 5,601,398. Commonly owned U.S. Pat. Nos. 5,310,308; 5,409,357; and 5,551,835 disclose pumps of the general type to which the present invention relates, and such pumps provide certain benefits and advantages over certain other types of pumps. One benefit of such pumps is that a number of its parts may be fabricated from polymeric (i.e. plastic) materials.

Through the continuing development of such pumps, it has been discovered that the presence of certain particulate material in commercial fuel may abraid such synthetic materials and thereby encourage wearing of pump parts made of such materials. Because vanes of a plastic impeller of such a pump are quite small, and because running clearances between pumping chamber walls and such an impeller may also be small, it is believed desirable to reduce the extent of interaction of such particulate material with the internal pumping mechanism. Because an automotive vehicle manufacturer cannot at the present time reasonably rely on commercial fuel refiners to improve fuel purity, it has become incumbent on the vehicle manufacturer to find a solution.

SUMMARY OF THE INVENTION

The present invention relates to a solution for the situation just described.

One general aspect of the present invention relates generally to a pump comprising: a pump housing comprising an internal pumping chamber; a fluid inlet to, and a fluid outlet from, the pumping chamber spaced arcuately apart about an axis; and a pumping element that is disposed within the housing for rotation about the axis and has a vaned periphery that is operable within the pumping chamber to pump fluid from the inlet to the outlet when the pumping element is rotated; the pumping chamber being defined at least in part by a main channel extending within the housing arcuately about the axis to one axial side of the pumping element; the main channel having a radially outer margin that opens along at least a portion of the channel's arcuate extent to an adjoining contaminant collection channel which extends arcuately within the housing about the axis and which is effective as the pumping element rotates, to collect certain fluid-entrained particulates expelled from the main channel and to convey such collected particulates toward the outlet, the contaminant collection channel being arranged and constructed in relation to the main channel such that the presence of the contaminant collection channel in the pump creates no substantial change in pumping efficiency.

Another general aspect relates to a pump comprising: a pump housing comprising an internal pumping chamber; a fluid inlet to, and a fluid outlet from, the pumping chamber spaced arcuately apart about an axis; and a pumping element that is disposed within the housing for rotation about the axis and has a vaned periphery that is operable within the pumping chamber to pump fluid from the inlet to the outlet when the pumping element is rotated; the pumping chamber being defined at least in part by a main channel extending within the housing arcuately about the axis to one axial side of the pumping element; and the pumping element comprises a central circular body containing a succession of circumferentially spaced, radially outwardly directed, vanes, a circular ring that girdles the vanes, spokes that are disposed between adjacent vanes and join the ring to the central circular body, and the ring having a radially inner surface that faces the vanes and that has a curvature that is concave toward the vanes as viewed in radial cross section.

Still another general aspect relates to a method of collecting fluid-entrained particulates in a pump to reduce internal abrasion of an internal pumping mechanism of the pump, the pump comprising a housing having an internal pumping chamber; a fluid inlet to, and a fluid outlet from, the pumping chamber spaced arcuately apart about an axis; and a pumping element that is disposed within the housing for rotation about the axis and has a vaned periphery that is operable within the pumping chamber to pump fluid from the inlet to the outlet when the pumping element is rotated; the pumping chamber being defined at least in part by a main channel extending within the housing arcuately about the axis to one axial side of the pumping element; the method comprising: providing the main channel with a radially outer margin that opens along at least a portion of the channel's arcuate extent to an adjoining contaminant collection channel which extends arcuately within the housing about the axis; and rotating the pumping element to operate the pump and contemporaneously expel fluid-entrained particulates from the main channel into the contaminant collection channel, and conveying such collected particulates toward the outlet, without creating substantial change in pumping efficiency because of the presence of the contaminant collection channel in the pump.

Other general and more specific aspects will been set forth in the ensuing description and claims.

BRIEF DESCRIPTION OF THE DRAWINGS

The drawings that will now be briefly described are incorporated herein to illustrate a preferred embodiment of the invention and a best mode presently contemplated for carrying out the invention.

DESCRIPTION OF THE PREFERRED EMBODIMENT(S)

Figure 4:
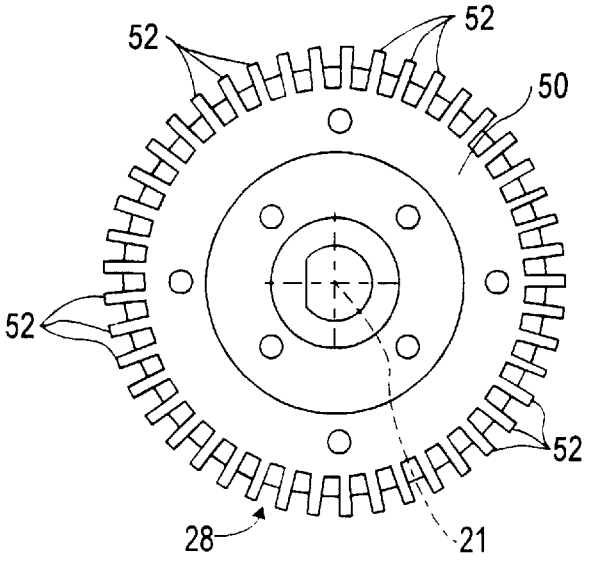
FIG. 4 is a full view in the direction of arrows 4—4 in FIG. 3.
Figure 1:
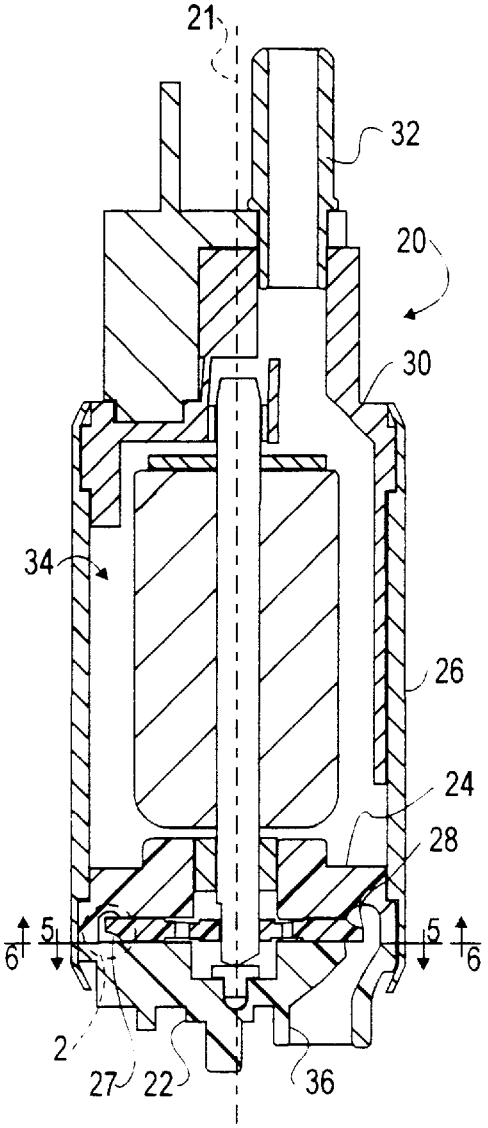
FIG. 1 is a longitudinal cross section view of a fuel pump embodying principles of the invention.
Figure 3:
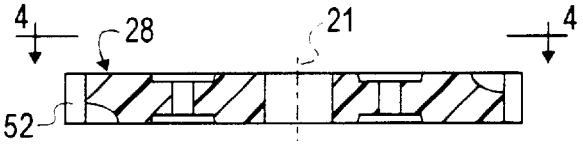
FIG. 3 is an enlarged view of one part of the fuel pump of FIG. 1, namely a vaned pumping element, by itself.

In FIGS. 1–7 an automotive vehicle fuel pump 20 embodying principles of the present invention, and having an imaginary longitudinal axis 21, is shown to comprise a housing that includes a pump bottom 22 and a pump cover 24 cooperatively arranged to close of one axial end of a cylindrical sleeve 26 and to cooperatively define an internal pumping chamber 27 within which a pumping element 28 is disposed for rotation about axis 21. The opposite axial end of sleeve 26 is closed by a part 30 that contains an exit tube 32 via which fuel exits pump 20. Part 30 is spaced from pump cover 24 to provide an internal space for an electric motor 34 that rotates pumping element 28 when pump 20 runs. Motor 34 comprises an armature including a shaft 38 journaled for rotation about axis 21 and having a keyed connection at one end for imparting rotational motion to pumping element 28.

Pump 20 is intended to be at least partially submerged in a fuel tank of an automotive vehicle for running wet. A passage that extends through pump bottom 22 provides an inlet 36 to pumping chamber 27. A passage that extends through pump cover 24 provides an outlet 40 from pumping chamber 27. Fuel that leaves outlet 40 passes through motor 34 and exits pump 20 via tube 32 from whence the fuel is pumped to an engine through an engine fuel handling system (not shown).

Figure 2:
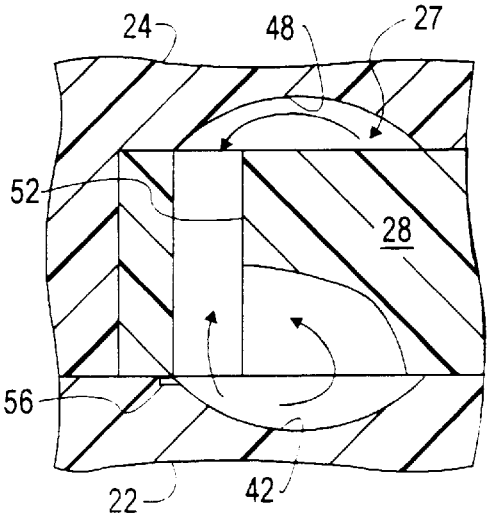
FIG. 2 is an enlarged view in circle 2 in FIG. 1.
Figure 5:
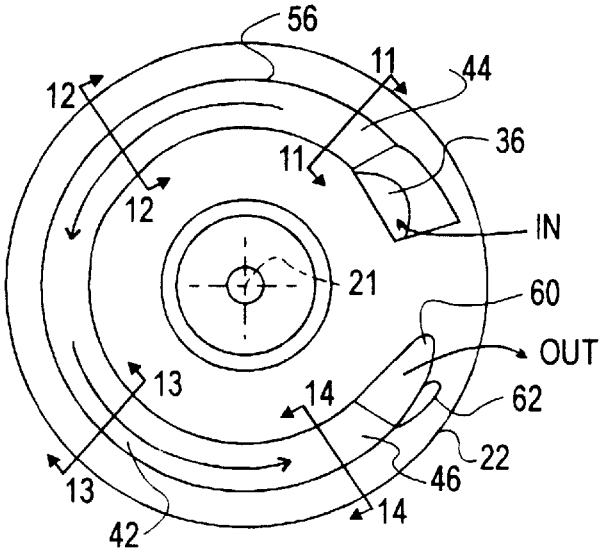
FIG. 5 is an enlarged view in the direction of arrows 5—5 in FIG. 4.
Figure 6:
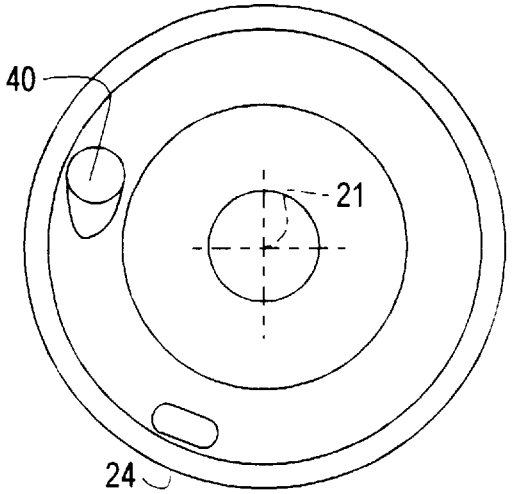
FIG. 6 is an enlarged view in the direction of arrows 6—6 in FIG. 4.
Figure 7:
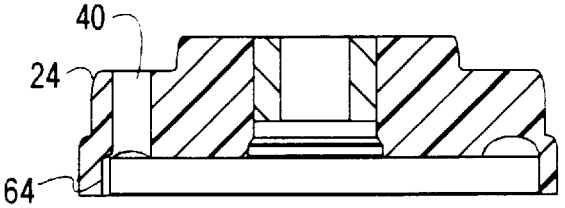
FIG. 7 is a cross section view taken along line 7—7 in FIG. 6.

Pumping chamber 27 comprises a main channel 42 extending arcuately about axis 21 in pump bottom 22 to one axial side of pumping element 28. As seen in FIG. 5, main channel 42 has a circumferential extent of more than 270°, but less than 360°. From a location 44 immediately proximate inlet 36, to a location 46 immediately proximate outlet 40, main channel 42 is essentially circular, having a substantially constant radial dimension. In radial cross section, main channel 42 is concave, as shown by FIG. 2. A further portion of pumping chamber 27 is provided by a main channel 48 formed in pump cover 24 opposite, and similar in geometry to, main channel 42.

Pumping element 28 comprises a circular body 50 having a series of circumferentially spaced apart vanes 52 around its outer periphery. As pumping element 28 is rotated by motor 34, its vaned periphery is effective to create a pressure differential between inlet 36 and outlet 40 that draws fluid through tube 30 and motor 34, moves the fluid through pumping chamber 28, and forces the fluid out of pump 20 through outlet 40.

Figure 10:
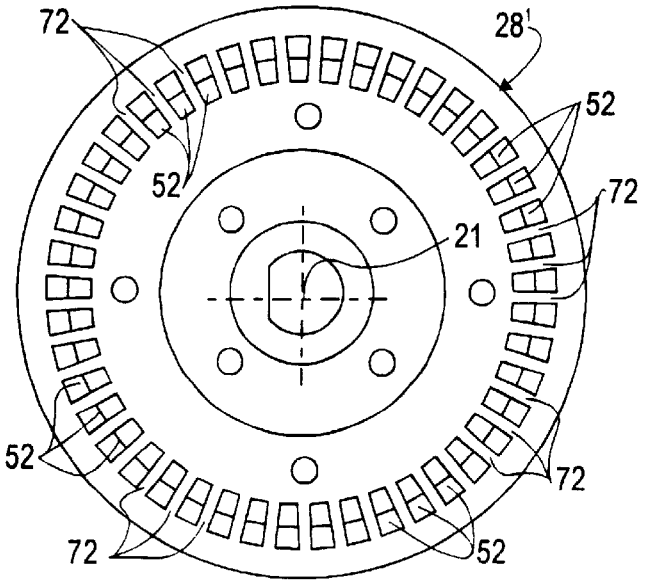
FIGS. 8, 9, and 10 are views similar to the views of FIGS. 2, 3, and 4 showing another embodiment.
Figure 9:
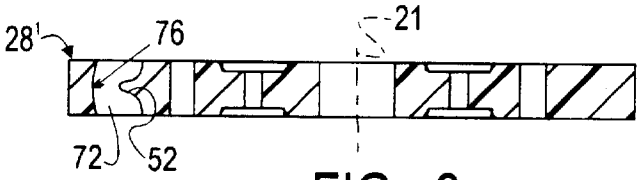
Figure 8:
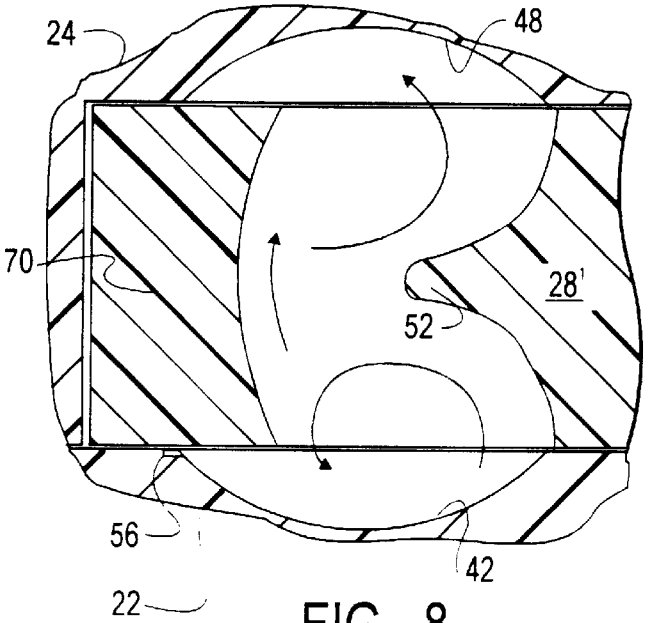
Figure 11:
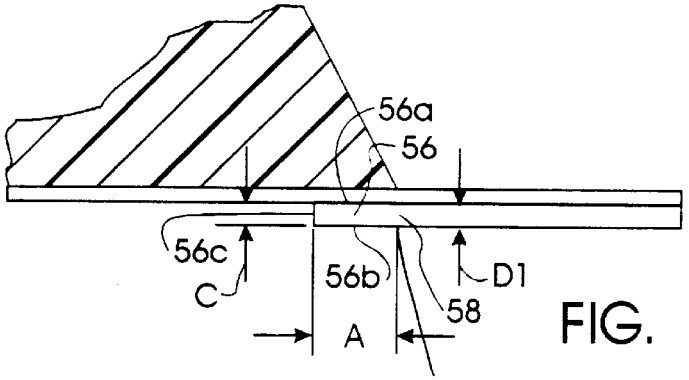
FIGS. 11, 12, 13, and 14 are enlarged fragmentary cross section views taken through a pump at locations respectively represented by section lines 11—11, 12—12, 13—13 and 14—14 in FIG. 5.
Figure 12:
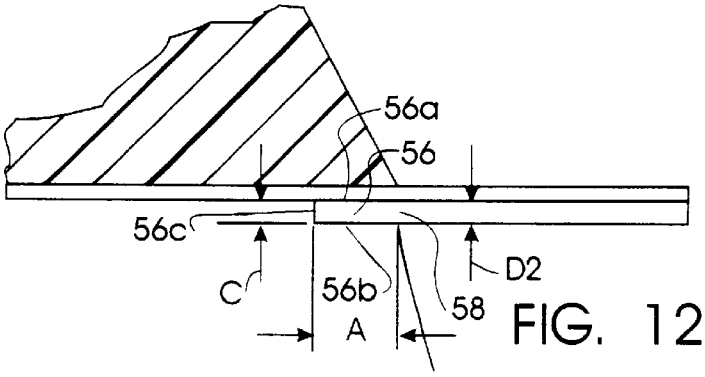
Figure 13:
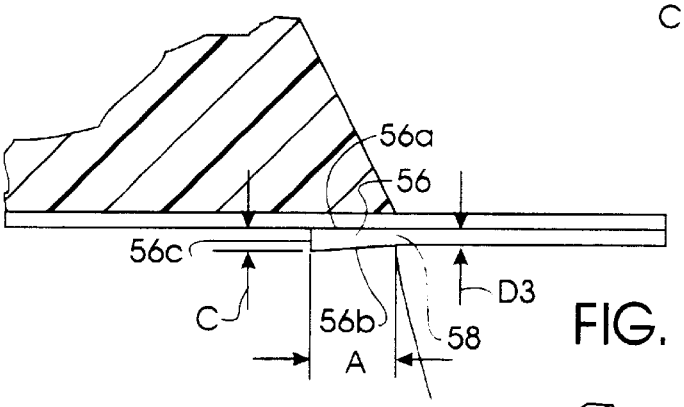
Figure 14:
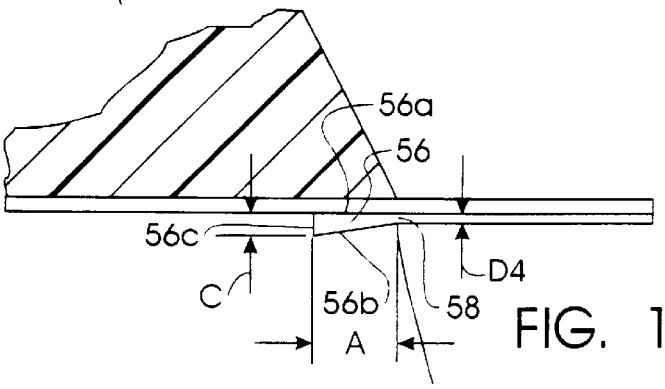

FIGS. 8, 9, and 10 illustrate a pump having an embodiment of pumping element 28' that differs from pumping element 28. Like pumping element 28, pumping element 28' is a molded plastic part. Pumping element 28' differs from pumping element 28 however in that it has a circular ring 70 that girdles vanes 52. Spokes 72 are disposed between adjacent vanes 52 and join ring 70 to central circular body 50. Thus, vanes 52 may be considered to be disposed in individual pockets in the outer margin of pumping element 28'.

Ring 70 differs from that shown in U.S. Pat. Nos. 5,310,308 and 5,409,357 in that its radially inner surface 76 that faces vanes 52 has a curvature that is concave toward the vanes as viewed in radial cross section. It is believed that such a curvature can enhance fuel swirling within the pockets containing the vanes and reduce vane edge wear. By way of example, such curvature may be a circularly curved 4.0 mm radius. In a pump that has a pumping element 28', the relative positioning of main channels 42 and 48 to the pumping element is as portrayed in FIG. 8.

In accordance with certain inventive principles, main channel 42 has a radially outer margin that opens along at least a portion of its arcuate extent to an adjoining contaminant collection channel 56 which extends arcuately about axis 21. The open area is designated by the reference numeral 58. In radial cross section, channel 56 is shown to be much smaller than main channel 42. As a pumping element 28 or 28' rotates, certain fluid-entrained particulates in fuel moving through the pump are propelled from main channel 42 through open area 58, presumptively by centrifugal forces. Contaminant collection channel 56 is effective to contain and convey such collected particulates in a direction toward outlet 40. Contaminant collection channel 56 is dimensioned in relation to main channel 42 such that the presence of contaminant collection channel 56 in pump 20 creates no substantial change in pumping efficiency in comparison to a like pump that lacks contaminant collection channel 56.

Beyond location 46, main channel 42 contracts to form an ending section 60 for transitioning the fuel flow toward outlet 40. At the end of contaminant collection channel 56 proximate outlet 40, a sump 62 is disposed outwardly adjacent ending section 60. Sump 62 is formed by an undercut in the same face of pump bottom 22 that contains contaminant collection channel 56. Sump 62 provides a volume where particulates that have been conveyed to it through channel 56 may collect before they are expelled from pump 20. Because outlet 40 is in pump cover 24, a slot 64 bridges sump 62 to outlet 40 radially outwardly of the periphery of both pumping element 28 and ending section 60. In this way slot 64 provides an escapement for particles to pass from sump 62 to outlet 40 out of the path of the rotating pumping element 28.

Contaminant collection channel 56 may, as shown by FIGS. 11–14, be considered to comprise two side wall surfaces 56*a*, 56*b*, and an end wall surface 56*c*. These Figures also show a geometry that is believed desirable for aiding containment of particulate matter in channel 56, once such matter has entered the channel. Along an initial portion of channel 56 extending from location 44, wall surfaces 56*a*, 56*b* may be uniformly spaced apart and parallel, making the axial dimension of open area 58 constant. As contaminant collection channel 56 approaches sump 62, wall surfaces 56*a*, 56*b* may depart from parallelism, while retaining flatness. For example, wall surface 56*b* may being to incline slightly so as to cause a progressive decrease in the axial dimension of open area 58, and a corresponding decrease in cross sectional area of contaminant collection channel 56 as viewed circumferentially of channel 56. It is believed that this gradual constriction aids the containment of particles moving through channel 56 and their eventual expulsion from the pump. Because known flow principles hold that decrease in cross sectional area available for flow creates corresponding increase in flow velocity, it is believed that acceleration is imparted to particles as they move along channel 56, promoting the immediate flushing of particles out of the pump instead of their accumulation in sump 62. Illustrative measurements for dimensions "A", "C" in all of FIGS. 11–14, and for dimensions "D1", "D2", "D3", and "D4" in respective ones of FIGS. 11–14 are as follows: "A"=0.100 mm; "C"=0.070 mm; "D1"=0.070 mm; "D2"=0.070 mm; "D3"=0.030 mm; and "D4"=0.010 mm.

It is believed that pumps embodying principles that have been described and illustrated herein can improve pump performance and durability. Moreover, principles relating to contaminant collection have been shown to be applicable to pumps having different forms of pumping elements 28 and 28'.

While a presently preferred embodiment has been illustrated and described, it is to be appreciated that the invention may be practiced in various forms within the scope of the following claims.

What is claimed is:

1. A pump comprising: a pump housing comprising an internal pumping chamber; a fluid inlet to, and a fluid outlet from, the pumping chamber spaced arcuately apart about an axis; and a pumping element that is disposed within the housing for rotation about the axis and has a vaned periphery that is operable within the pumping chamber to pump fluid from the inlet to the outlet when the pumping element is rotated; the pumping chamber being defined at least in part by a main channel extending within the housing arcuately about the axis to one axial side of the pumping element; the main channel having a radially outer margin that opens along at least a portion of the channel's arcuate extent to an adjoining contaminant collection channel which extends arcuately within the housing about the axis and which is effective, as the pumping element rotates, to collect certain fluid-entrained particulates expelled from the main channel and to convey such collected particulates to the outlet, the contaminant collection channel being arranged and constructed in relation to the main channel such that the presence of the contaminant collection channel in the pump creates no substantial change in pumping efficiency.

2. A pump as set forth in claim 1 in which the housing includes a sump which is disposed at an end of the contaminant collection channel and through which the contaminant collection channel has communication with the outlet.

3. A pump as set forth in claim 2 in which the housing comprises plural housing members cooperatively defining the pumping chamber; one housing member contains the sump, the contaminant collection channel, and the main channel; another housing member contains the outlet and another main channel that defines another portion of the pumping chamber to an axial side of the pumping element opposite the first-mentioned main channel.

4. A pump as set forth in claim 1 in which the pumping element comprises a central circular body containing a succession of circumferentially spaced, radially outwardly directed, vanes, a circular ring that girdles the vanes, and spokes that are disposed between adjacent vanes and join the ring to the central circular body.

5. A pump as set forth in claim 4 in which the ring has a radially inner surface that faces the vanes and that has a curvature that is concave toward the vanes as viewed in radial cross section.

6. A pump as set forth in claim 1 in which the radially outer margin of the main channel that opens along at least a portion of the channel's arcuate extent to the adjoining contaminant collection channel has an open dimension to the contaminant collection channel that, as measured axially, that is larger proximate the inlet than it is proximate the outlet.

7. A pump as set forth in claim 6 in which the open dimension of the radially outer margin of the main channel to the contaminant collection channel is substantially constant along an initial portion of its circumferential extent proximate the inlet and progressively diminishes along a subsequent portion toward the outlet.

8. A pump as set forth in claim 7 in which the contaminant collection channel is radially bounded by an outer wall that extends arcuately about the axis and that has a substantially constant axial dimension along its initial and subsequent portions.

9. A pump comprising: a pump housing comprising an internal pumping chamber; a fluid inlet to, and a fluid outlet from, the pumping chamber spaced arcuately apart about an axis; and a pumping element that is disposed within the housing for rotation about the axis and has a vaned periphery that is operable within the pumping chamber to pump fluid from the inlet to the outlet when the pumping element is rotated; the pumping chamber being defined at least in part by a main channel extending within the housing arcuately about the axis to one axial side of the pumping element; and the pumping element comprises a central circular body containing a succession of circumferentially spaced, radially outwardly directed, vanes, a circular ring that girdles the vanes, spokes that are disposed between adjacent vanes and join the ring to the central circular body, and the ring having a radially inner surface that faces the vanes and that has a curvature that is concave toward the vanes as viewed in radial cross section.

10. A pump as set forth in claim 9 in which the curvature of the radially inner surface of the ring of the pumping element lies on a radius of curvature that is substantially 4.0 mm.

11. A method of collecting fluid-entrained particulates in a pump to reduce internal abrasion of an internal pumping mechanism of the pump, the pump comprising a housing having an internal pumping chamber; a fluid inlet to, and a fluid outlet from, the pumping chamber spaced arcuately apart about an axis; and a pumping element that is disposed within the housing for rotation about the axis and has a vaned periphery that is operable within the pumping chamber to pump fluid from the inlet to the outlet when the pumping element is rotated; the pumping chamber being defined at least in part by a main channel extending within the housing arcuately about the axis to one axial side of the pumping element; the method comprising:

providing the main channel with a radially outer margin that opens along at least a portion of the channel's arcuate extent to an adjoining contaminant collection channel which extends arcuately within the housing about the axis; and rotating the pumping element to operate the pump and contemporaneously expel fluid-entrained particulates from the main channel into the contaminant collection channel, and conveying such collected particulates to the outlet, without creating substantial change in pumping efficiency because of the presence of the contaminant collection channel in the pump.

* * * * *